US011389807B2

(12) United States Patent
Sternberg

(10) Patent No.: US 11,389,807 B2
(45) Date of Patent: Jul. 19, 2022

(54) GOLF BUNKER FILTRATION DEVICE AND RELATED METHODS

(71) Applicant: CAPILLARY CONCRETE, LLC, Celebration, FL (US)

(72) Inventor: Martin Sternberg, Celebration, FL (US)

(73) Assignee: CAPILLARY CONCRETE, LLC, Celebration, FL (US)

( * ) Notice: Subject to any disclaimer, the term of this patent is extended or adjusted under 35 U.S.C. 154(b) by 0 days.

(21) Appl. No.: 17/154,581

(22) Filed: Jan. 21, 2021

(65) Prior Publication Data

US 2021/0220837 A1 Jul. 22, 2021

Related U.S. Application Data

(60) Provisional application No. 62/963,851, filed on Jan. 21, 2020.

(51) Int. Cl.

| | |
|---|---|
| ***E02B 11/00*** | (2006.01) |
| ***B03B 5/60*** | (2006.01) |
| ***E02B 11/02*** | (2006.01) |
| *A63B 69/36* | (2006.01) |

(52) U.S. Cl.

CPC ..... *B03B 5/60* (2013.01); *E02B 11/005* (2013.01); *E02B 11/02* (2013.01); *A63B 69/3691* (2013.01)

(58) Field of Classification Search

CPC ..... E02B 11/005; E02B 13/02; E01H 12/004; E01H 12/008; E01C 13/06

See application file for complete search history.

(56) References Cited

U.S. PATENT DOCUMENTS

| | | | | |
|---|---|---|---|---|
| 3,685,657 | A | 8/1972 | Hunter et al. | |
| 5,108,627 | A | 4/1992 | Berkebile et al. | |
| 6,615,469 | B1 | 9/2003 | Burcham | |
| 6,982,034 | B2 | 1/2006 | Roberts et al. | |
| 7,264,418 | B1 * | 9/2007 | Houck | E03F 3/046 405/47 |
| 7,399,145 | B2 * | 7/2008 | Clark | A63B 69/3691 405/258.1 |
| 8,062,143 | B1 * | 11/2011 | Meersman | E01C 13/02 473/173 |
| 8,409,437 | B2 | 4/2013 | Roberts et al. | |
| 9,045,874 | B1 * | 6/2015 | Kondas | E02D 31/02 |

(Continued)

FOREIGN PATENT DOCUMENTS

JP 2012091124 A * 5/2012

*Primary Examiner* — Benjamin F Fiorello
(74) *Attorney, Agent, or Firm* — Allen, Dyer et al.

(57) ABSTRACT

A golf bunker cleaning device includes a base having an open top end and an open bottom end defining an interior open space therebetween and the base configured to be buried below a ground surface of a golf bunker without filling in the interior open space. An extension collar is configured to be removably secured over the open top end of the base to increase a height of the interior open space to above the ground surface of the golf bunker, and a lid is configured to be removably secured over either the top end of the base or over the extension collar to enclose the interior open space. The extension collar comprises a plurality of collar latches each extending to a respective free end, and the base comprises a plurality of base locking apertures configured to releasable engage the respective free end of the plurality of collar latches.

20 Claims, 7 Drawing Sheets

(56) References Cited

U.S. PATENT DOCUMENTS

| | | | | |
|---|---|---|---|---|
| 10,159,887 | B2 * | 12/2018 | Jones | A63B 69/3691 |
| 2003/0082004 | A1 * | 5/2003 | Wilkerson | E01C 13/02<br>405/43 |
| 2005/0100412 | A1 * | 5/2005 | Houck | E03F 3/046<br>405/125 |
| 2006/0051161 | A1 * | 3/2006 | Benson | E01C 13/02<br>405/36 |
| 2013/0184090 | A1 * | 7/2013 | Sternberg | E01C 7/142<br>106/738 |
| 2017/0191230 | A1 * | 7/2017 | Doble | E01C 13/06 |
| 2018/0021654 | A1 * | 1/2018 | Doble | E01C 13/02<br>473/173 |

* cited by examiner

GOLF BUNKER FILTRATION DEVICE AND RELATED METHODS

CROSS-REFERENCE TO RELATED APPLICATIONS

This application claims the benefit of U.S. provisional application No. 62/963,851 filed Jan. 21, 2020, which is hereby incorporated herein in its entirety by reference.

FIELD

The present invention relates to the field of golf course maintenance, and, more particularly, to a golf bunker filtration device and related methods.

BACKGROUND

Golf course bunkers are depressions near the green or fairway of a golf course and are filled with sand. The bunkers are easy to construct but can be difficult to maintain. The bunker sand needs to be clean and consistent so that the players can hit the ball from the bunker. However, dirt and other small debris often gets mixed into the sand and contaminates the bunker sand, which reduces the quality of the bunker. This can be caused by rain, wind, and irrigation water being washed into the bunker so that the sand is not clean. Dirty sand in golf course bunkers is highly undesirable and typically must be removed and replaced with clean sand, which can be expensive and time consuming. Accordingly, there is a need in the art for a device that can efficiently clean the bunker sand.

SUMMARY

A golf bunker cleaning device is disclosed. The device includes a base having an open top end and an open bottom end defining an interior open space therebetween and the base configured to be buried below a ground surface of a golf bunker without filling in the interior open space, an extension collar configured to be removably secured over the open top end of the base to increase a height of the interior open space to above the ground surface of the golf bunker, and a lid configured to be removably secured over either the top end of the base or over the extension collar to enclose the interior open space. The extension collar has a plurality of collar latches each extending to a respective free end, and the base has a plurality of base locking apertures configured to releasable engage the respective free end of the plurality of collar latches, and a front archway and a rear archway configured to accommodate a drain pipe. In addition, the lid includes a plurality of lid latches each extending to a respective free end, and the extension collar has a plurality of collar locking apertures configured to releasable engage the respective free end of the plurality of lid latches.

The device may also include at least one additional extension collar configured to be stacked directly over the extension collar to further increase a height of the interior open space, and the base may have a plurality of drainage slots configured to allow water to pass into the interior space. A shape of the base may narrow from the bottom end to the top end.

In another particular aspect, a method for cleaning a golf bunker is disclosed. The method includes using a device comprising a base installed over a drainage pipe buried in the golf bunker, where the base has an open top end and an open bottom end defining an interior open space therebetween, an extension collar configured to be removably secured over the open top end of the base, and a lid configured to be removably secured over either the top end of the base or over the extension collar to enclose the interior open space. The method includes removing the lid, securing the extension collar over the open top end of the base to increase a height of the interior open space to above a ground surface of the golf bunker, and pumping water into the golf bunker until the water flows over a top edge of the extension collar and into the interior open space to the drainage pipe so that sand of the golf bunker is cleaned.

The method may also include removing the extension collar after the sand has been cleaned, and replacing the lid over the top end of the base. In addition, the method may include leaving at least one extension collar secured to the base when the drainage pipe is deeper below the ground surface than a height of the base. In addition, the method includes releasably engaging a plurality of collar latches of the extension collar with a plurality of base locking apertures of the base, and releasably engaging a plurality of lid latches with a plurality of lid locking apertures of the extension collar or base locking apertures of the base.

DETAILED DESCRIPTION

In the following detailed description, preferred embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well known constructions or functions are not described in detail, so as not to obscure the present invention.

Figure 1:
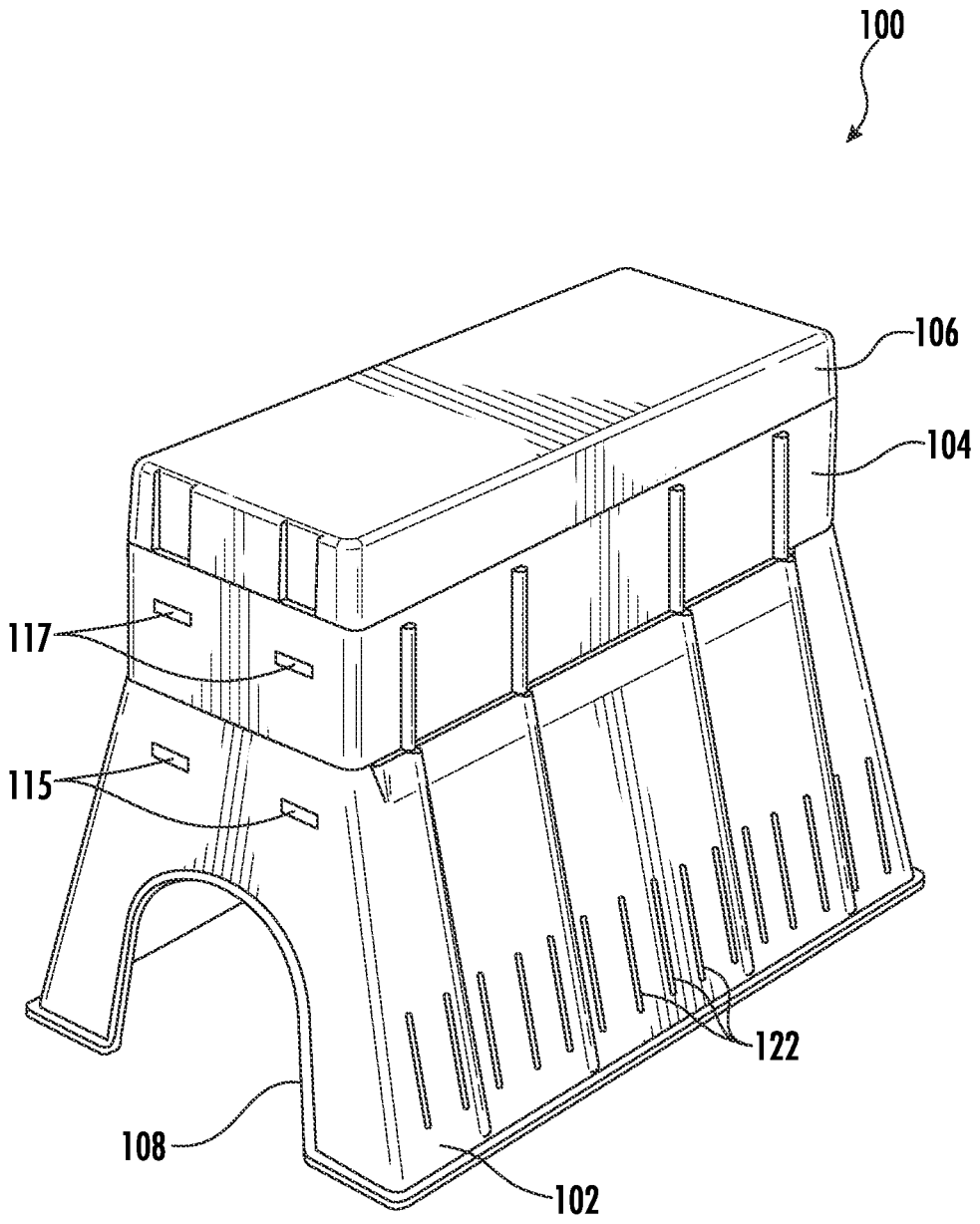
FIG. 1 is a perspective view of a golf bunker filtration device in which various aspects of the disclosure may be implemented.
Figure 2:
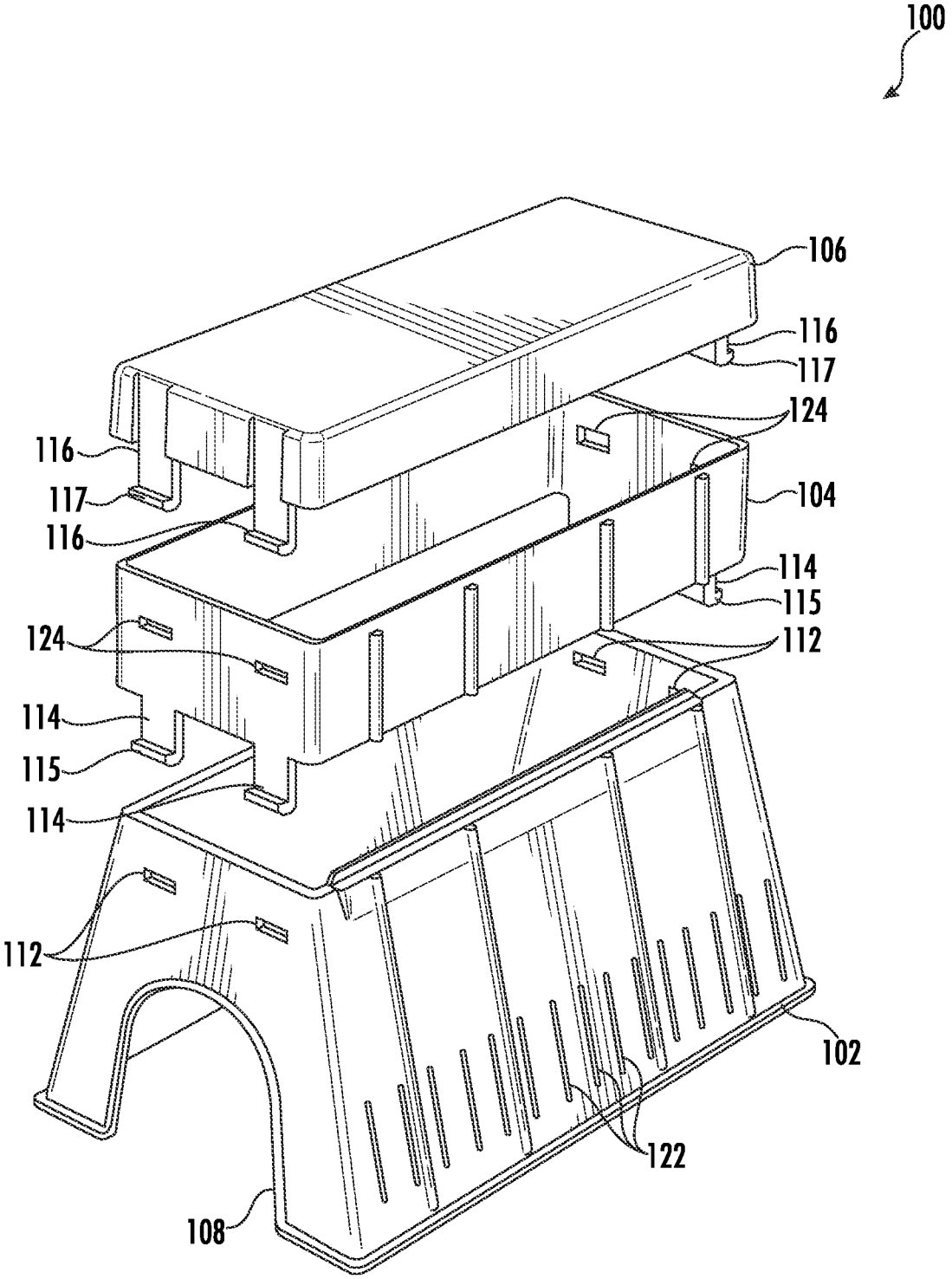
FIG. 2 is an exploded perspective view of the golf bunker filtration device of FIG. 1.
Figure 3:
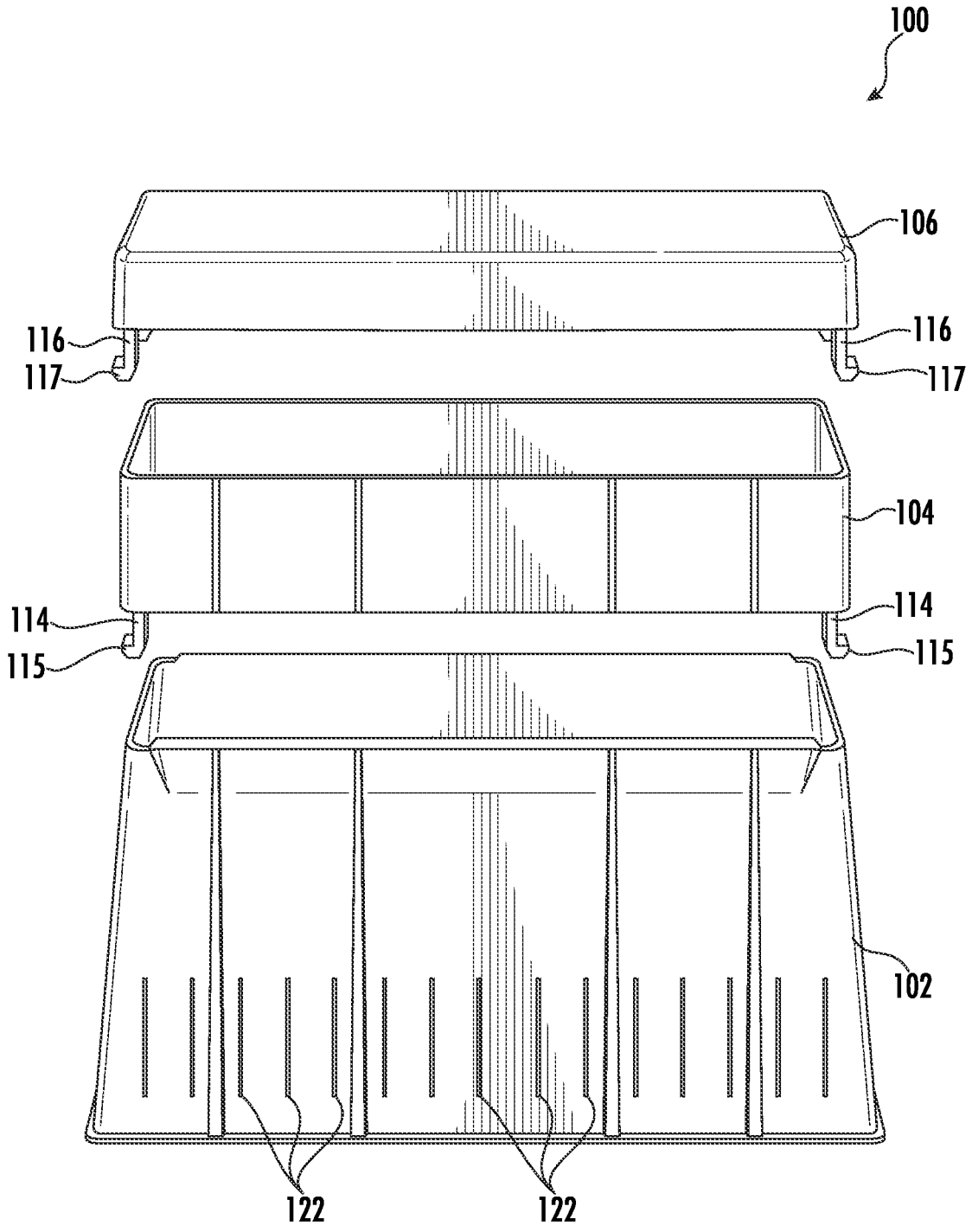
FIG. 3 is an exploded elevational view of the golf bunker filtration device of FIG. 1.

Referring now to FIGS. 1-3, a golf bunker filtration device is disclosed and generally designated 100. The device 100 includes a base 102 having an open top end and an open bottom end defining an interior open space therebetween.

The base 102 is configured to be buried below a ground surface of a golf bunker without filling in the interior open space. The base 102 may narrow from the bottom end to the top end to increase its structural stability and have a truncated rectangular pyramid shape.

The base 102 includes a front archway 108 and a rear archway 110 configured to accommodate a drainage pipe 130 located below ground in the bunker and passing through the device 100. The base 102 also includes a plurality of drainage slots 122 that are configured to allow water to pass into the interior space to reach the drainage pipe 130 when the device 100 is not being used to wash the bunker sand.

An extension collar 104 of the device 100 is configured to be removably secured over the open top end of the base 102 to increase a height of the interior open space to reach above the ground surface of the golf bunker. A top of the extension collar 104 extends up from the ground surface to create a lip so that the device 100 will function properly when the bunker sand is being washed and keep debris from being washed down into the base 102 and clog the drainage pipe 130. The device 100 includes a lid 106 that is configured to be removably secured over either the top end of the base 102 or over the extension collar 104 to enclose the interior open space.

For example, when the device 100 is not in use, the extension collar 104 may be removed so that it no longer extends above the ground surface. The top end of the base 102 is below the ground surface so that when the lid 106 is installed to the base 102 and the extension collar 104 has been removed, sand will not fill in the interior space. Accordingly, the device 100 can be completely buried so as to not interfere with game play when a golf ball enters the bunker. In another aspect, the lid 106 can be secured to the extension collar 104 and then buried in the bunker. The specific arrangement of the device 100 will depend, in part, on the depth of the drainage pipe in the bunker and its location.

In order to secure the extension collar 104 to the base 102, the extension collar 104 has a plurality of collar latches 114, each extending to a respective free end 115. As those of ordinary skill in the art can appreciate, there may be more or less collar latches 114 than two on each end as depicted in the drawings. The base 102 has a plurality of base locking apertures 112 configured to releasable engage the respective free end 115 of the plurality of collar latches 114.

Similar to the extension collar 104, the lid 106 has a plurality of lid latches 116 each extending to a respective free end 117. The extension collar 104 has a plurality of collar locking apertures 124 configured to releasable engage the respective free end 117 of the plurality of lid latches 116.

Figure 4:
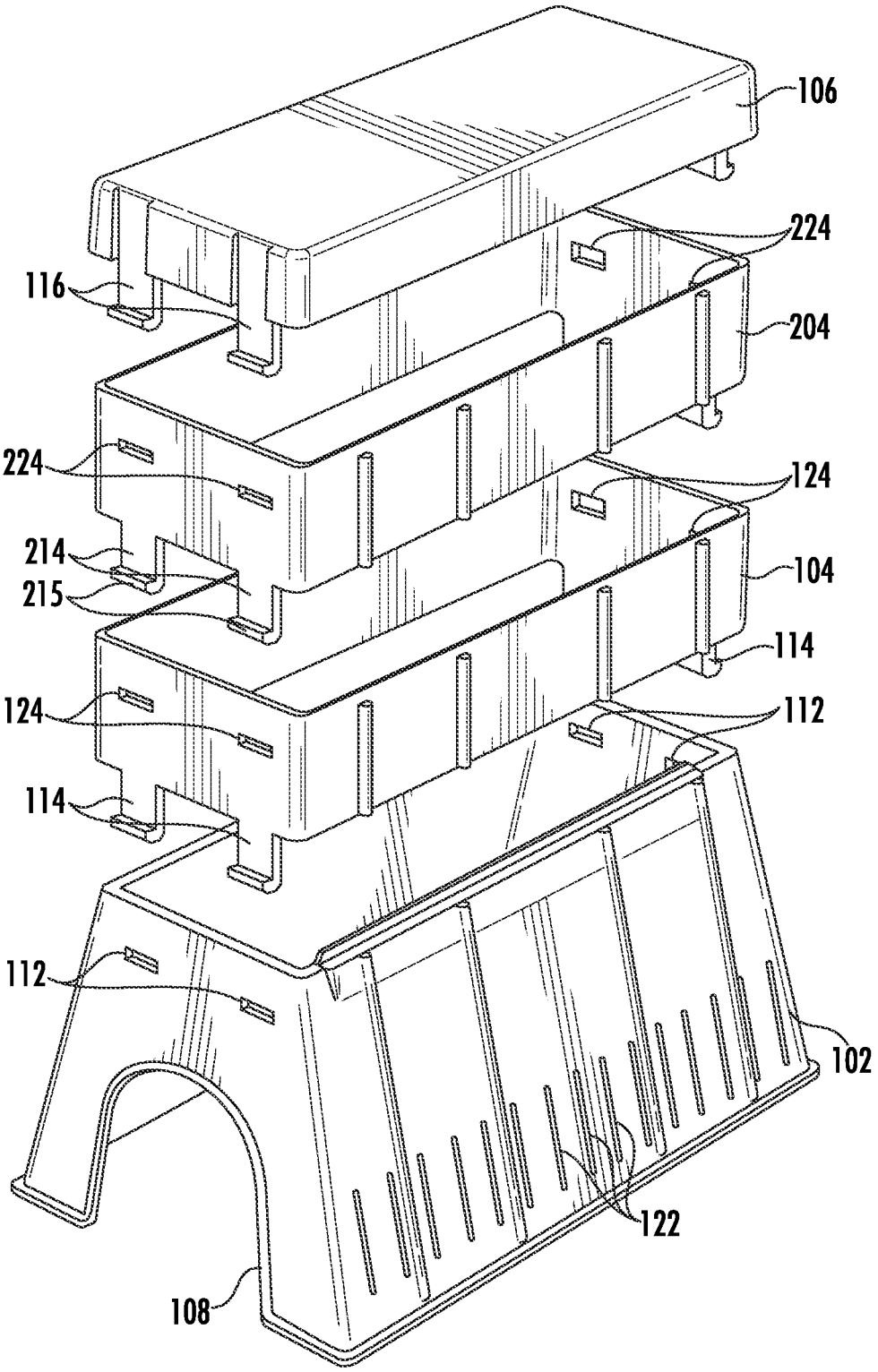
FIG. 4 is an exploded perspective view of the golf bunker filtration device of FIG. 1 with an additional collar extension.

In a particular aspect, there may be more than one extension collar required in order to reach from the drainage pipe 130 to above the ground surface of the bunker. As shown in FIG. 4, an additional extension collar 204 may be stacked directly over the extension collar 104 to further increase a height of the interior open space. The additional extension collar 204 includes a plurality of collar latches 214, each extending to a respective free end 215. The extension collar 104 has a plurality of collar locking apertures 124 configured to releasable engage the respective free end 215 of the plurality of collar latches 214 of the additional extension collar 204.

The lid 106 is secured to the additional extension collar 204 in the same manner as it is to the extension collar 104 explained above. The additional extension collar 204 has a plurality of collar locking apertures 224 configured to releasable engage the respective free end 117 of the plurality of lid latches 116.

Figure 5:
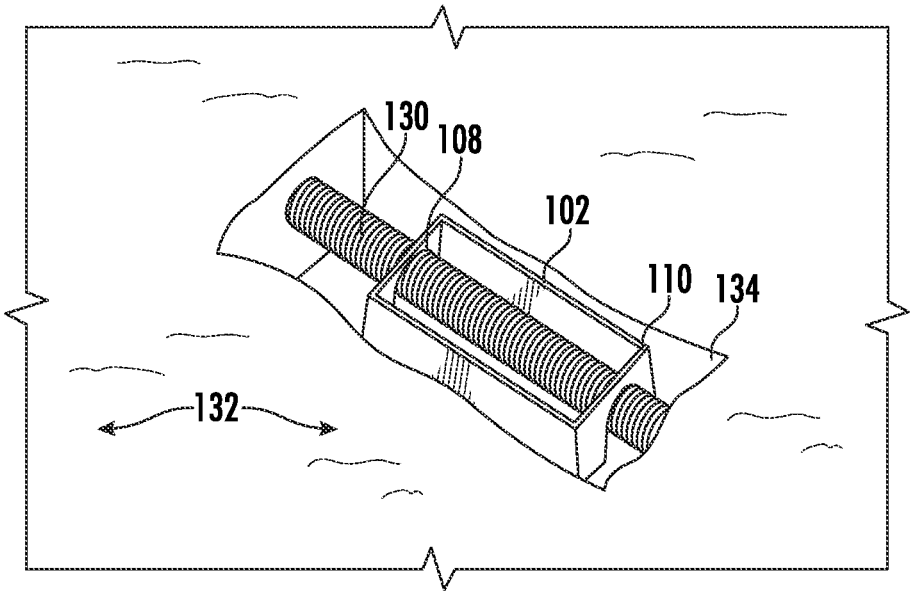
FIG. 5 is a top view of an excavation of a golf bunker with a base of the golf bunker filtration device of FIG. 1 being installed within a trench.
Figure 6:
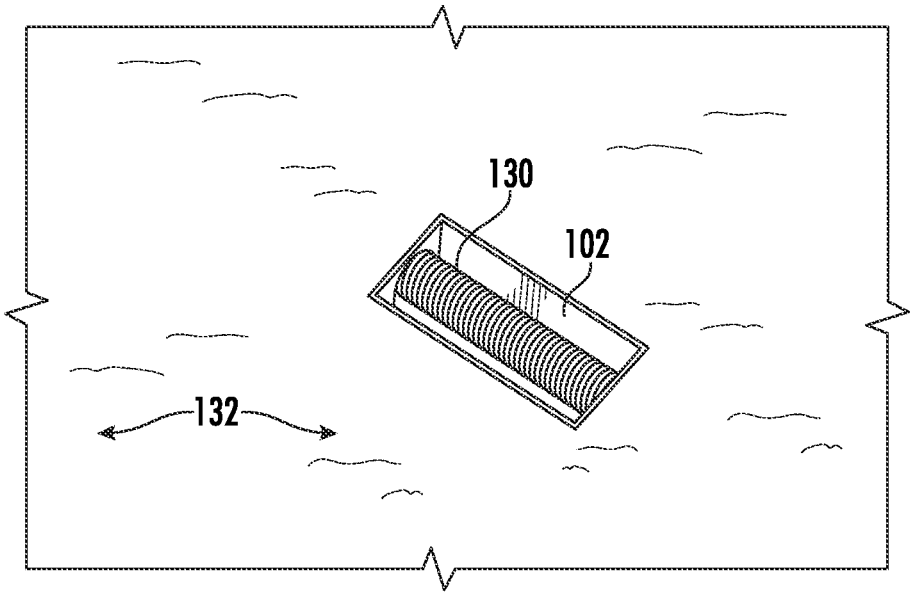
FIG. 6 is a top view of the trench being filled around the base of the golf bunker filtration device.
Figure 7:
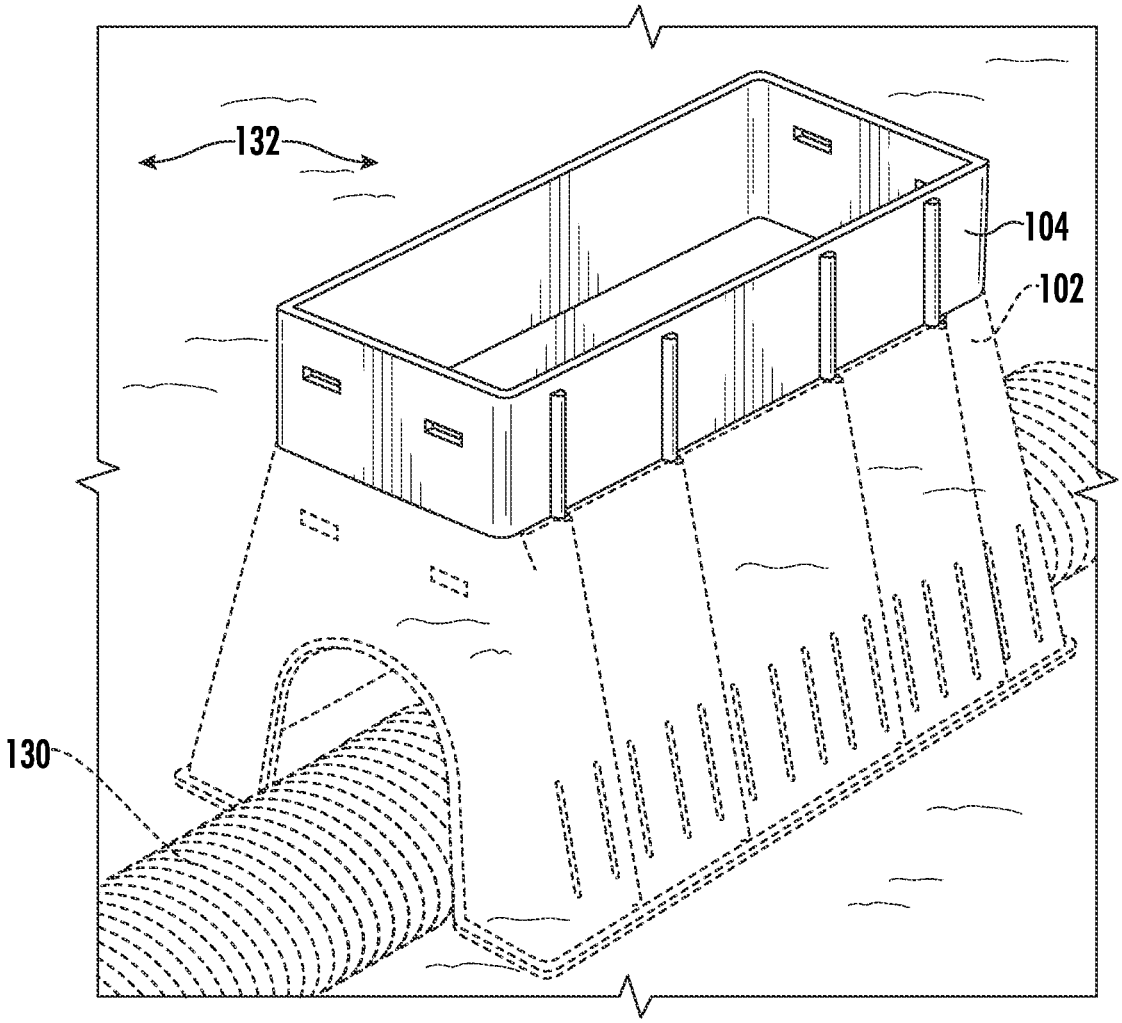
FIG. 7 is a perspective view of the base and extension collar of the golf bunker filtration device of FIG. 1 installed within the golf bunker.

Referring now to FIGS. 5-7, the base 102 of the golf bunker filtration device 100 is placed within a trench 134 of the bunker 132. The base 102 is mounted over the drainage pipe 130 within the trench 134. The drainage pipe 130 passes through the front archway 108 and into the interior space of the base 102 and out the rear archway 110. The front and rear archways 108, 110 are configured to prevent dirt, sand or other materials from entering the base 102. The drainage pipe 130 is typically found in the base of every bunker and usually comprises a type of perforated pipe that collects water and discharges the water to a pond or proximate water feature.

Once the base 102 has been installed over the drainage pipe 130 in the trench 134, dirt and sand is used to fill the trench 134 around the base 102 as shown in FIG. 6. The top end of the base 102 may be at ground level so that the lid 106 can be secured to it. More sand can be heaped over the top of the lid 106 so that the device 100 does not interfere with game play. As explained above, if the drainage pipe 130 is relatively deep in the ground so that the top of the base 102 is not close enough to the ground surface, one or more extension collars 104, 204 may be used to reach the height of the ground surface.

In another particular aspect, a method for cleaning a golf bunker using the device 100 installed in the golf bunker 132 is disclosed. The method includes removing the lid 106, and securing one or more extension collars 104, 204 over the open top end of the base 102 to increase a height of the interior open space to above a ground surface of the golf bunker 132 as shown in FIG. 7. Alternatively, once the lid 106 is removed, the sand around the open end of the base 102 can be excavated to create the lip instead of using an extension collar 104, 204.

Figure 8:
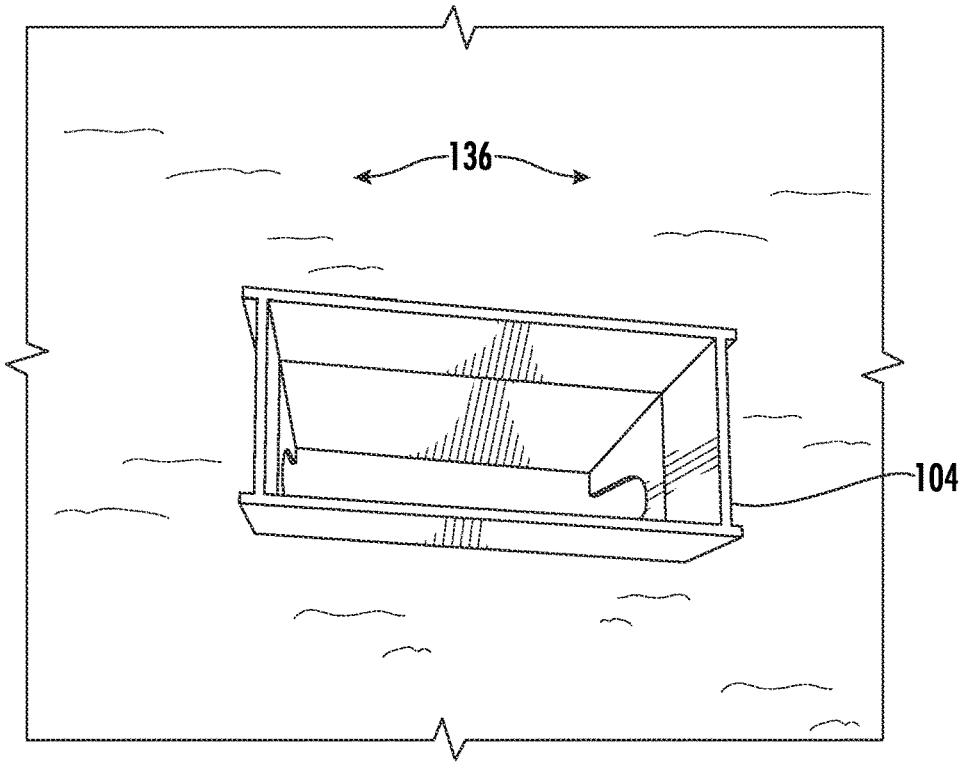
FIG. 8 is a perspective view of the golf bunker being flooded with water.
Figure 9:
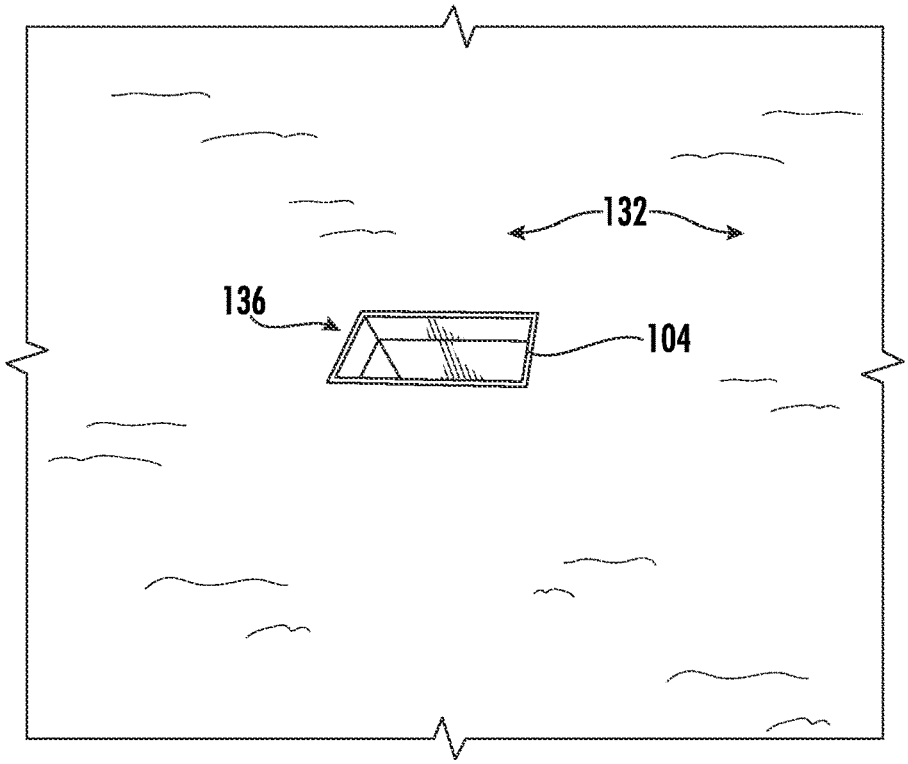
FIG. 9 is a perspective view of water flowing into the golf bunker filtration device and filtering the bunker of debris.

Next, water is pumped into the golf bunker 132, as shown in FIG. 8. Water is continued to be flooded into the bunker 132 so that the water reaches a depth to flow over a top edge of the extension collar 104 (or 204), as shown in FIG. 9, and into the interior open space to the drainage pipe 130 to be discharged. The rinsing action of the water flowing through the sand of the golf bunker 132 causes the dirt and other lighter debris to float as the fine particles and dirt are slurred into the water and are removed from the sand while leaving the sand behind. The bunker 132 continues to be flooded with water until the sand is relatively cleaned or for a predetermined time duration. Once the bunker has been filtered and cleaned, the bunker is playable and the water drainage rate of the bunker will be improved because the device 100 causes the sand particles to remain in the bunker but the dirt and silt/clay are removed.

After the bunker 132 has been cleaned, the extension collar 104 can be removed as needed, and the lid 106 is secured over the top end of the base 102. The method may include leaving one or more extension collars secured to the base 102 when the drainage pipe 103 is deep below the ground surface relative to a height of the base 102. The lid 106, collar extensions 104 and base 102 are secured together by releasably engaging a plurality of collar latches 114 of the extension collar 104 with a plurality of base locking apertures 112 of the base 102, and releasably engaging a plurality of lid latches 116 with a plurality of lid locking apertures 124 of the extension collar 104 or base locking apertures 112 of the base 102.

The device 100 may also include or be coupled to a moisture meter to monitor moisture levels in the bunker 132.

In addition, some or all the components of the device 100 may be comprised in part, or in whole, of mesh netting that will allow fine dirt particles to pass but prevent sand particles from entering. Mesh netting may also be used as a lid for the device 100.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope possible consistent with the principles and novel features as defined herein.

That which is claimed is:

1. A golf bunker filtration device comprising:

a base having an open top end and an open bottom end defining an interior open space therebetween and the base configured to be buried below a ground surface of a golf bunker without filling in the interior open space;

an extension collar configured to be removably secured over the open top end of the base to increase a height of the interior open space to above the ground surface of the golf bunker; and a lid configured to be removably secured over either the top end of the base or over the extension collar to enclose the interior open space.

2. The golf bunker filtration device of claim 1, wherein the extension collar comprises a plurality of collar latches each extending to a respective free end.

3. The golf bunker filtration device of claim 2, wherein the base comprises a plurality of base locking apertures configured to releasable engage the respective free end of the plurality of collar latches.

4. The golf bunker filtration device of claim 1, wherein the base comprises a front archway and a rear archway configured to accommodate a drain pipe.

5. The golf bunker filtration device of claim 1, wherein the lid comprises a plurality of lid latches each extending to a respective free end.

6. The golf bunker filtration device of claim 5, wherein the extension collar comprises a plurality of collar locking apertures configured to releasable engage the respective free end of the plurality of lid latches.

7. The golf bunker filtration device of claim 1, further comprising at least one additional extension collar configured to be stacked directly over the extension collar to further increase a height of the interior open space.

8. The golf bunker filtration device of claim 1, wherein the base comprises a plurality of drainage slots configured to allow water to pass into the interior space.

9. The golf bunker device of claim 1, wherein a shape of the base narrows from the bottom end to the top end.

10. A golf bunker filtration device comprising:

a base having an open top end and an open bottom end defining an interior open space therebetween and the base configured to be buried below a ground surface of a golf bunker without filling in the interior open space;

an extension collar configured to be removably secured over the open top end of the base to increase a height of the interior open space to above the ground surface of the golf bunker, the extension collar having a plurality of collar latches each extending to a respective free end having a collar locking tab; and a lid configured to be removably secured over either the top end of the base or over the extension collar to enclose the interior open space.

11. The golf bunker filtration device of claim 10, wherein the base comprises a plurality of base locking apertures configured to releasable engage the respective collar locking tab of the plurality of collar latches.

12. The golf bunker filtration device of claim 11, wherein the lid comprises a plurality of lid latches each extending to a respective lid locking tab.

13. The golf bunker filtration device of claim 12, wherein the extension collar comprises a plurality of collar locking apertures configured to releasable engage the respective lid locking tab of the plurality of lid locking latches.

14. The golf bunker filtration device of claim 10, further comprising at least one additional extension collar configured to be stacked directly over the extension collar to further increase the height of the interior open space.

15. The golf bunker filtration device of claim 10, wherein the base comprises a plurality of drainage slots configured to allow water to pass into the interior space.

16. A method for cleaning a golf bunker using a golf bunker filtration device comprising a base installed over a drainage pipe buried in the golf bunker, the base having an open top end and an open bottom end defining an interior open space therebetween, an extension collar configured to be removably secured over the open top end of the base, and a lid configured to be removably secured over either the top end of the base or over the extension collar to enclose the interior open space, the method comprising:

removing the lid;

securing the extension collar over the open top end of the base to increase a height of the interior open space to above a ground surface of the golf bunker; and pumping water into the golf bunker until the water flows over a top edge of the extension collar and into the interior open space to the drainage pipe and sand of the golf bunker is cleaned.

17. The method of claim 16, further comprising removing the extension collar after the sand has been cleaned, and replacing the lid over the top end of the base.

18. The method of claim 17, further comprising leaving at least one additional extension collar secured to the base when the drainage pipe is deeper below the ground surface than a height of the base.

19. The method of claim 17, further comprising releasably engaging a plurality of collar latches of the extension collar with a plurality of base locking apertures of the base.

20. The method of claim 19, further comprising releasably engaging a plurality of lid latches with a plurality of lid locking apertures of the extension collar.

* * * * *